US009328939B2

(12) United States Patent
Edens et al.

(10) Patent No.: US 9,328,939 B2
(45) Date of Patent: May 3, 2016

(54) AIR HANDLING UNIT WITH MIXED-FLOW BLOWER

(75) Inventors: John R. Edens, Kilgore, TX (US); Jeffrey L. Stewart, Whitehouse, TX (US)

(73) Assignee: Trane International Inc., Piscataway, NJ (US)

( * ) Notice: Subject to any disclaimer, the term of this patent is extended or adjusted under 35 U.S.C. 154(b) by 763 days.

(21) Appl. No.: 12/609,978

(22) Filed: Oct. 30, 2009

(65) Prior Publication Data

US 2011/0100051 A1 May 5, 2011

(51) Int. Cl.
*F24F 13/04* (2006.01)
*F24F 1/00* (2011.01)
*F24F 13/30* (2006.01)

(52) U.S. Cl.
CPC ..... *F24F 13/04* (2013.01); *F24F 1/0007* (2013.01); *F24F 13/30* (2013.01)

(58) Field of Classification Search
CPC ..... F24H 3/065; F24F 13/04; F24F 13/30; F24F 1/0007
USPC ..... 62/179, 180, 238.6, 259.1, 279, 291, 62/296, 298, 324, 407, 411, 419, 426, 140, 62/176.6; 165/110, 120, 122, 126–127, 165/133, 140, 150, 197; 415/206, 213.1, 415/214.1, 219; 96/18, 55, 63; 126/110 R, 126/116 R, 110; 422/178; 454/251, 338; 237/12.1
See application file for complete search history.

(56) References Cited

U.S. PATENT DOCUMENTS 19,260 A 7/1934 Shurtleff
2,268,778 A * 1/1942 Schueder et al. ..... 126/67
2,740,268 A * 4/1956 Jones ..... F24F 3/14 165/124
2,780,445 A 2/1957 Rimbach
3,147,541 A * 9/1964 Hathaway ..... 29/889.4
4,548,050 A * 10/1985 Drucker ..... F24F 1/0007 62/285
5,067,560 A 11/1991 Carey et al.
5,228,197 A * 7/1993 Cox ..... F24F 1/0007 29/469
5,284,027 A * 2/1994 Martin, Sr. ..... F24F 13/30 165/126
6,547,519 B2 * 4/2003 deBlanc et al. ..... 415/141
7,065,978 B2 * 6/2006 Hong ..... F24F 1/0007 126/110 R
2004/0187517 A1 * 9/2004 Solomon ..... F24F 11/022 62/404
2008/0160902 A1 * 7/2008 Desler ..... F24F 1/0007 454/251

FOREIGN PATENT DOCUMENTS

JP 2005-299432 * 10/2005 ..... F04D 29/44
JP 2005299432 * 10/2005 ..... F04D 29/44

* cited by examiner

*Primary Examiner* — Emmanuel Duke
(74) *Attorney, Agent, or Firm* — Conley Rose, P.C.; J. Robert Brown, Jr.; Michael J. Schofield

(57) ABSTRACT

An air handling unit has a cabinet forming a duct, a mixed-flow blower assembly configured to provide airflow through the duct, and a refrigeration coil assembly disposed within the cabinet and downstream of the mixed-flow blower assembly. Another air handling unit has a cabinet forming a duct having a generally downstream direction and a blower assembly to provide airflow through the duct. The blower assembly may have an axis of rotation generally parallel to the downstream direction and the blower assembly may be configured to primarily expel air in a direction that has a directional component that extends radially away from the axis of rotation.

8 Claims, 3 Drawing Sheets

AIR HANDLING UNIT WITH MIXED-FLOW BLOWER

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and air conditioning systems (HVAC systems) sometimes comprise air handling units having a refrigeration coil assembly and a blower assembly.

SUMMARY OF THE DISCLOSURE

In some embodiments, an air handling unit is provided that comprises a cabinet forming a duct, a mixed-flow blower assembly configured to provide airflow through the duct, and a refrigeration coil assembly disposed within the cabinet and downstream of the mixed-flow blower assembly.

In other embodiments, an air handling unit is provided that comprises a cabinet forming a duct having a generally downstream direction and a blower assembly to provide airflow through the duct. The blower assembly may comprise an axis of rotation generally parallel to the downstream direction and the blower assembly may be configured to primarily expel air in a direction that comprises a directional component that extends radially away from the axis of rotation.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Some air handling units (AHUs) may comprise a blower assembly configured to draw air through a refrigeration coil assembly by creating a relatively lower pressure generally downstream of the refrigeration coil assembly. Other air handling units may comprise a blower assembly configured to force air through a refrigeration coil assembly by directing a relatively higher pressure flow of air through a refrigeration coil assembly. In some cases, an AHU configured to force air through a refrigeration coil assembly may be desirable over an AHU configured to draw air through a refrigeration coil. However, some AHUs configured to force air through refrigeration coils may nonetheless exhibit inefficiencies due in part to a portion of the refrigeration coil assembly being located near an air output opening of the blower assembly. More specifically, when a portion of a refrigeration coil assembly (or other AHU component) is located close to an output opening of a blower assembly, some areas of the AHU may experience localized areas of lowered pressure and resultant lower pressure, may increase the power consumption of the blower assembly, and/or may decrease an airflow rate through the refrigeration coil assembly. Further, the use of some traditional blower assemblies in some AHUs may tend to provide localized zones of increased pressure within a cabinet of the AHU while other zones of the same cabinet may be provided with relatively lower pressure. Such variation in pressure within a single cabinet that comprises a refrigeration coil assembly may lead to an increase in non-homogeneous airflow through the refrigeration coil assembly. Accordingly, the present disclosure provides, in some embodiments among others, an AHU configured to more uniformly pressurize a cabinet comprising a refrigeration coil assembly. In some embodiments, the refrigeration coil assembly is of the so-called "V-type" with outer sides of the refrigeration coil being exposed to a relatively more homogeneously pressurized portion of a cabinet. In some embodiments, the refrigeration coil assembly is of the "V-type" and the vertex of the refrigeration coil assembly is located nearer the blower assembly than the open end of the refrigeration coil assembly. In some embodiments, the mixed-flow blower assembly comprises a backwards curved blade assembly, a plenum fan, and/or a direct driven fan.

Figure 1:
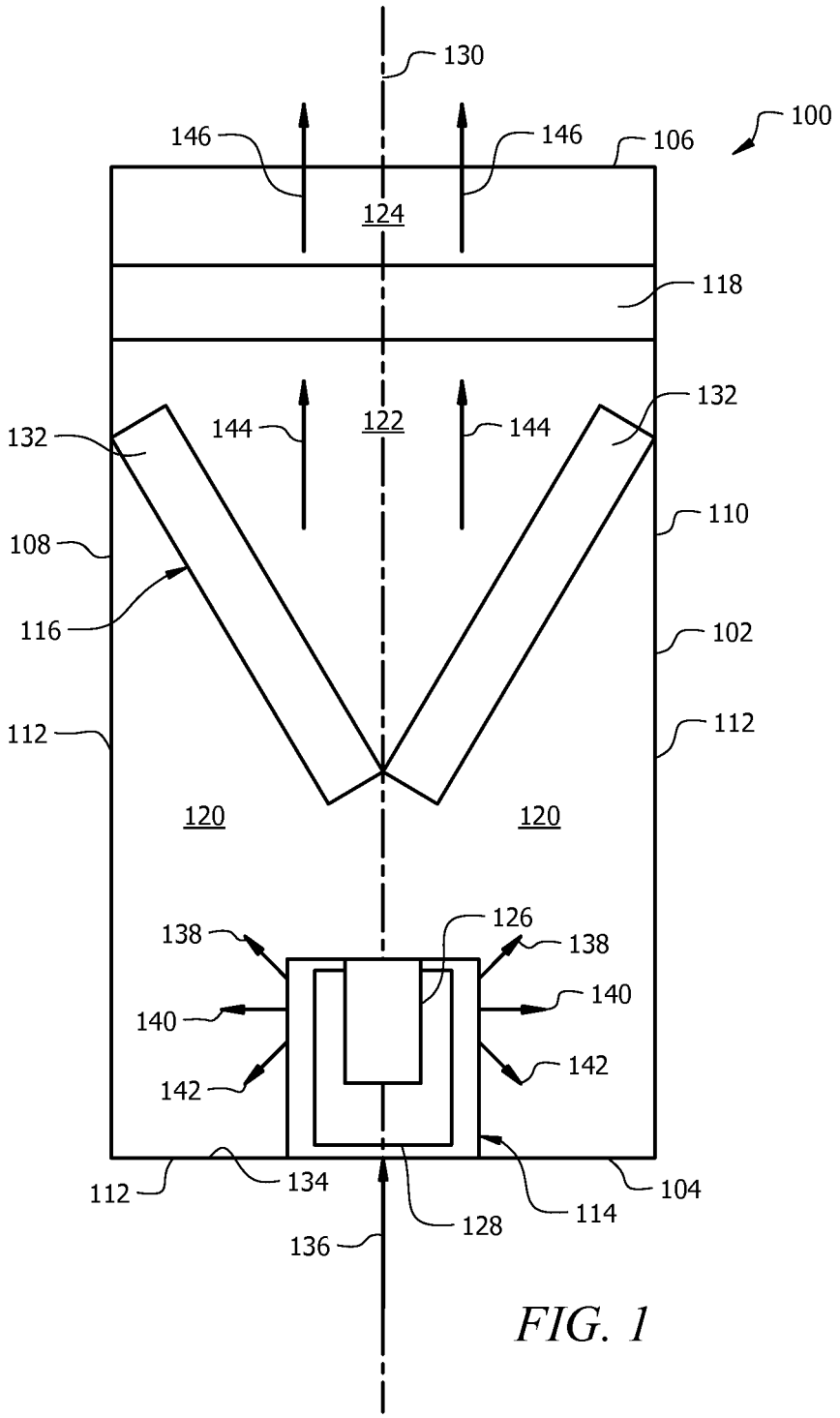
FIG. 1 is a simplified schematic view of an air handling unit according to an embodiment of the disclosure.

Referring now to FIG. 1, an AHU 100 according to the disclosure is shown. In this embodiment, AHU 100 comprises a cabinet 102 that serves to substantially form a fluid duct that receives air in through a bottom side 104 of the AHU and expels air out through a top side 106 of the AHU. The AHU further comprises a left side 108, a right side 110, a front side, and a back side, each substantially defined by cabinet walls 112. It will be appreciated that such directional descriptions are meant to assist the reader in understanding the physical orientation of the various component parts of the AHU 100. However, such directional descriptions shall not be interpreted as limitations to the possible installation orientations of an AHU 100. The component parts and/or assemblies of the AHU 100 may be described below as generally having top, bottom, front, back, left, and right sides which should be understood as being consistent in orientation with the top side 106, bottom side 104, front side, back side, left side 108, and right side 110 of the AHU 100.

The AHU 100 comprises a plurality of components that may generally define separate zones of space within the cabinet 102. More specifically, the AHU 100 comprises a blower assembly 114, a refrigeration coil assembly 116, and a heater assembly 118. The blower assembly 114 may be configured to comprise an inlet in fluid communication with a space exterior to the AHU 100 and an outlet in fluid communication with a blower pressure zone 120. The blower pressure zone 120 may be defined as a space generally bound by the interiors of the cabinet walls 112, the outlet of the blower assembly 114, and the upstream boundaries of the refrigeration coil assembly 116. An intermediate zone 122 of the cabinet 102 may generally be defined as a space not only being bound by the cabinet walls 112 but also being between the downstream boundaries of the refrigeration coil assembly 116 and the upstream boundaries of the heater assembly 118. Further, an exit zone 124 of the cabinet 102 may be defined as a space not only being bound by the cabinet walls 112 but also being between the downstream boundaries of the heater assembly 118 and the top side of the cabinet 102.

In this embodiment, mixed-flow blower assembly 114 comprises a motor 126. Motor 126 is generally configured to rotate a blade assembly 128 about an axis of rotation 130. In this embodiment, the blade assembly 128 comprises backwards curved blades. The distal ends of each blade of the blade assembly 128 comprise trailing edges that generally follow behind and/or trail other portions of the blade as the blade is rotated about the axis of rotation 130. In other words, in some embodiments, the leading edge of backwards curved blades may be generally radially closer to the axis of rotation 130 of the blade assembly 128 as compared to the trailing edge of the same blades.

Refrigeration coil assembly 116, in this embodiment, comprises two fin slabs 132 positioned substantially in a "V-coil" arrangement. In this disclosure, a V-coil arrangement may be a refrigeration coil assembly in which one or more fin slabs 132 are positioned relative to each other so that an end view of the refrigeration coil assembly 116 generally presents a V-shaped cross-sectional shape. Further, in this disclosure, a V-coil arrangement may indicate that a vertex portion of the V-shaped refrigeration coil assembly is generally located further upstream and/or nearer an intake of the duct formed by the cabinet 102 than an output of the duct formed by the cabinet 102. In this embodiment, the intake of the duct formed by the cabinet 102 may be generally associated with the bottom side 104 while the output of the duct of cabinet 102 may be associated with the top side 106. The heater assembly 118 may comprise one or more electrical heater elements, a hydronic heating coil, a fuel-burning heat exchanger, or other heat generation devices.

The AHU 100 may be operated to transfer air from the intake of the duct formed by the cabinet 102, through one or more components and/or zones of the AHU 100 and out the output of the duct formed by cabinet 102. More specifically, the mixed-flow blower assembly 114 may be operated to rotate the blade assembly 128 about the axis of rotation 130 to cause the above-described airflow. In this embodiment, the mixed-flow blower assembly 114 may be carried by and/or otherwise associated with a bottom wall 134 of the cabinet 102. The bottom wall 134 may substantially block airflow into the duct formed by the cabinet 102 with the exception of an opening in the bottom wall 134 associated with the mixed-flow blower assembly 114. Accordingly, rotation of the blade assembly 128 may cause incoming air 136 to pass through the mixed-flow blower assembly 114 and into the blower pressure zone 120.

In this embodiment, the incoming air 136 is expelled from the mixed-flow blower assembly 114 in various directions. In this embodiment, some air may be expelled from the mixed-flow blower assembly 114 in a direction that generally comprises a downstream directional component. Such air expelled with a downstream direction component is graphically represented as downstream airflow 138. Further, some air may be expelled from the mixed-flow blower assembly 114 in a direction that is generally radially away from the axis of rotation 130. Such air expelled generally laterally and radially away from the axis of rotation 130 is graphically represented as lateral airflow 140. Still further, some air may be expelled from the mixed-flow blower assembly 114 in a direction that generally comprises an upstream direction component. Such air expelled with an upstream component is graphically represented as upstream airflow 142.

It will be appreciated that such variety in the direction of air expelled from the mixed-flow blower assembly 114 may be referred to as mixed-flow rejection. Such mixed-flow rejection may generally contribute to an increased homogeneity of air pressure within the blower pressure zone 120 as compared to the air pressure distribution cabinets receiving airflow from traditional centrifugal blowers. For example, traditional centrifugal blowers generally provide a column of higher air pressure air and higher flow rate at the outlet of the blower assembly that is only dispersed after contacting a coil assembly or other obstruction. Homogenizing the air pressure by striking a coil assembly may generally be associated with a loss of efficiency. Further, where pressure distribution within a cabinet and/or against a coil assembly varies greatly, the resultant flow of air through the coil assembly will likewise vary, leading to less efficient heat transfer between the coil assembly and the air passing through the coil assembly.

In response to the increase of pressure within the blower pressure zone 120, air is forced through the refrigeration coil assembly 116 and subsequently into the intermediate zone 122. Airflow from the intermediate zone 122 to the heater assembly 118 is graphically represented as intermediate airflow 144. The higher air pressure within the blower pressure zone 120 forces air to flow from the intermediate zone 122, through the heater assembly 118, and into the exit zone 124. Air is finally forced from the exit zone 124 through the top side 106 and out of the AHU 100. Airflow from the exit zone 124 to a space exterior to the AHU 100 is graphically represented as exit airflow 146. While intermediate airflow 144 and exit airflow 146 are shown as comprising directional components primarily in a downstream direction, in other embodiments, the airflows 144, 146 may comprise a variety of directional components. In some embodiments, the top side 106 may be associated with air distribution ducts for delivering conditioned air to air-conditioned spaces or comfort zones. Similarly, the bottom side 104 may be associated with air return ducts that serve to supply air to the AHU 100 from a selected space.

It will be appreciated that, in some embodiments, the relatively homogeneous air pressure within the blower pressure zone 120 promotes homogeneous distribution of airflow through the fin slabs 132 which may provide an increase in efficiency of heat transfer between the air and the refrigeration coil assembly 116. Further, the backwards curved design of the blades of blade assembly 128 and the mixed-flow rejection provided by the mixed-flow blower assembly 114 may provide an increase in overall efficiency of the AHU 100. In some embodiments, the increase in efficiency may be due to a more optimized air path where air can enter the mixed-flow blower assembly 114 from the AHU 100 inlet via a substantially straight line path. Additionally, the orientation of the V-coil above the mixed-flow blower assembly 114 may facilitate a less restricted path for air to exit the mixed-flow blower assembly 114. In this embodiment, the mixed-flow blower assembly 114 is configured to expel air in directions that are not straight paths toward the refrigeration coil assembly 116. More specifically, air is expelled from mixed-flow blower assembly 114 so expelled air has initial directional components and/or vectors that, if unchanged due to mixing the airflow with other expelled air, allows the expelled air to encounter a wall 112 of the cabinet 102 or other component of AHU 100 instead of being directed primarily toward the refrigeration coil assembly 116. However, in other embodiments, a mixed-flow blower assembly 114 may be configured to expel air in any number of directions, including rejecting some air directly toward the refrigeration coil assembly 116. In some embodiments, a blower assembly 114 may be configured to draw air in that develops directional components of greater magnitudes parallel to the axis of rotation 130 than the directional components radial to the axis of rotation 130 as the air passes through an aperture in the lower wall 134. In some embodiments, a mixed-flow blower assembly 114 may be configured to primarily expel air with directional components of greater magnitudes radial to the axis of rotation 130 than the directional components parallel to the axis of rotation 130.

While some embodiments are described as comprising a refrigeration coil assembly as a first heat exchanger to receive airflow from the mixed-flow blower assembly 114, in other embodiments, any other heat exchanger device may be configured to receive the pressurized air from the blower pressure zone 120. For example, an AHU may comprise a heater assembly but no refrigeration coil assembly and the heater assembly may receive the airflow generated by the mixed-flow blower assembly 114. In other embodiments, the mixed-flow blower assembly 114 may be configured to similarly pressurize a blower pressure zone 120 but with the axis of rotation of the mixed-flow blower assembly 114 being other than substantially parallel to the longitudinal length of the AHU 100. For example, in some embodiment, an AHU 100 may comprise a lower wall 134 that has no aperture for airflow while a cabinet wall 112 such as the left, right, front, and/or back cabinet wall 112 of the AHU 100 does comprise an aperture. In such embodiments, an axis of rotation associated with a mixed-flow blower assembly 114 may generally extend through the aperture in the cabinet wall 112. Of course, the axis of rotation need not be substantially perpendicular to any one of the cabinet walls 112, 134.

Figure 2:
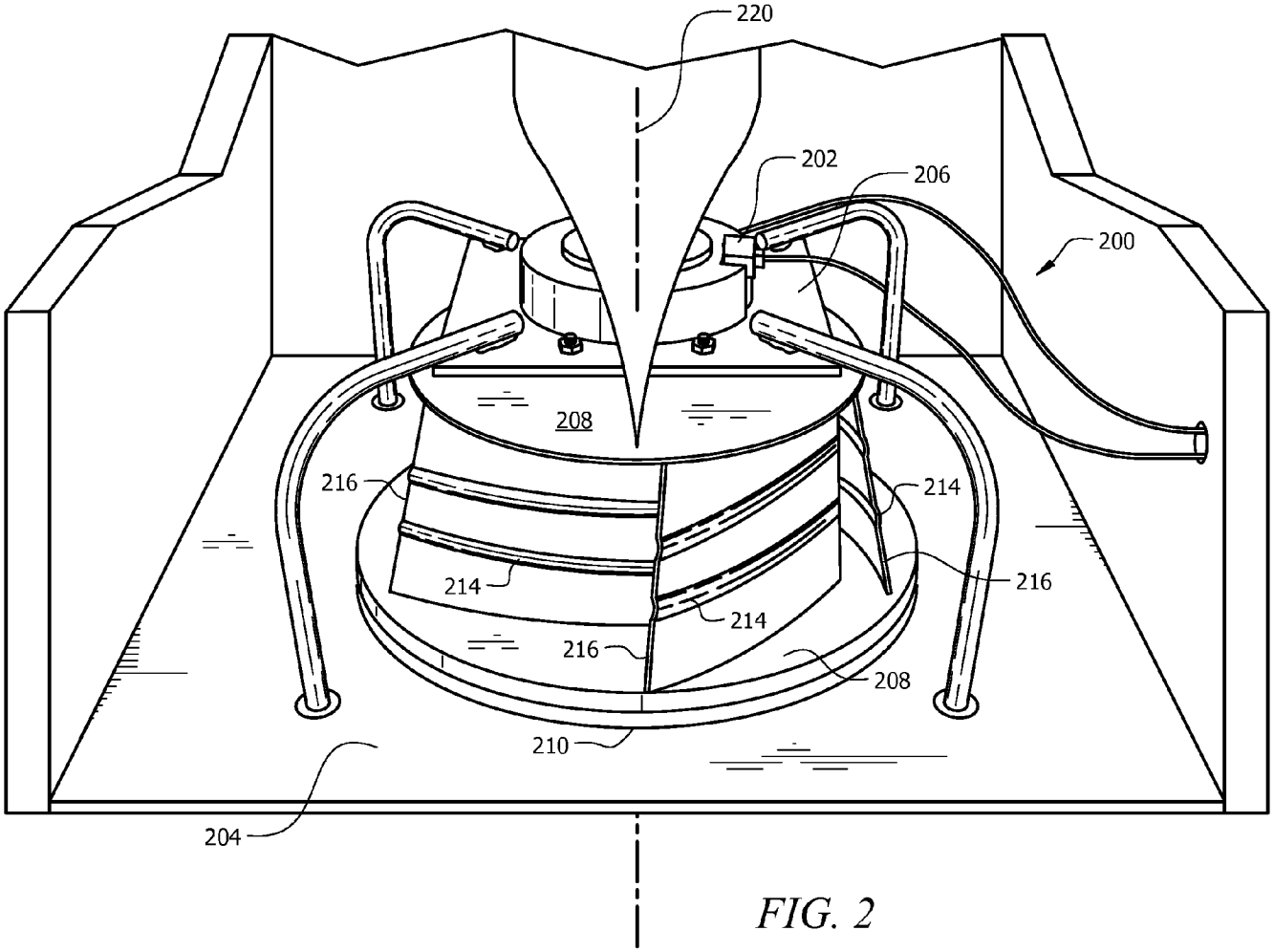
FIG. 2 is an oblique top view of a mixed-flow blower assembly according to an embodiment of the disclosure.
Figure 3:
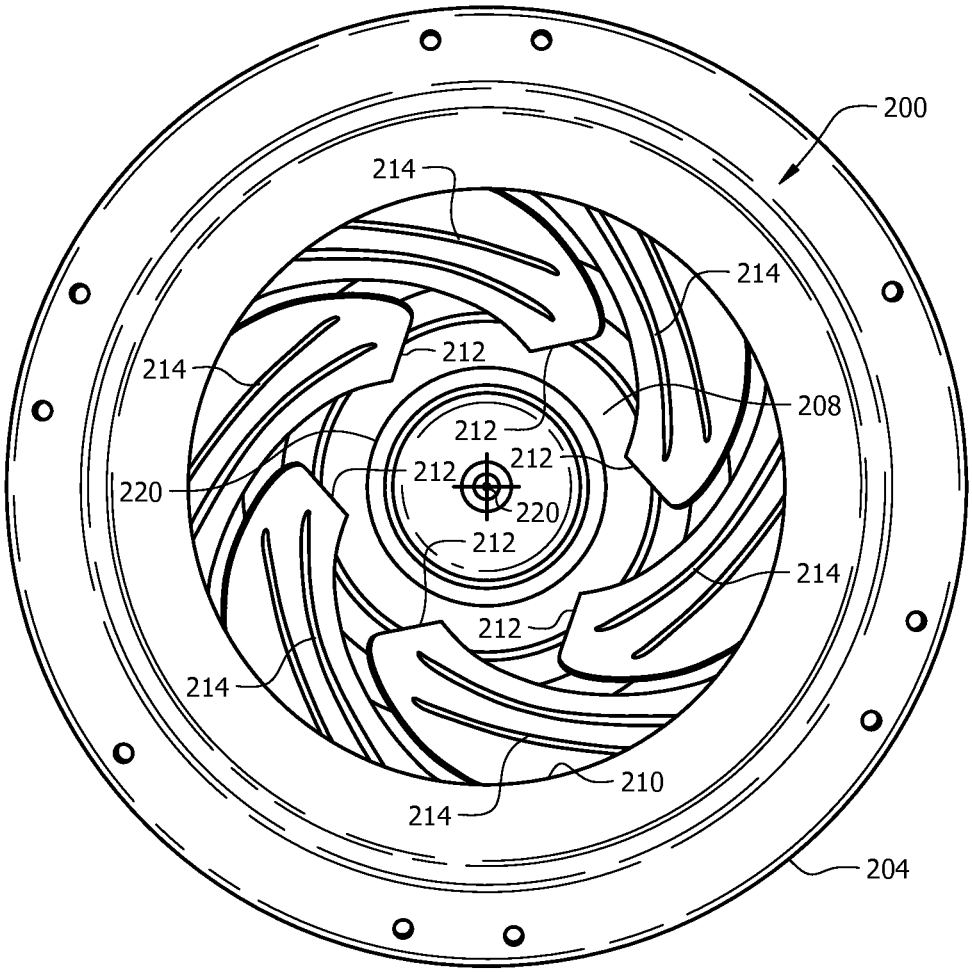
FIG. 3 is a bottom view of the mixed-flow blower assembly of FIG. 2.

Referring now to FIGS. 2 and 3, another embodiment of a mixed-flow blower assembly 200 is shown. Mixed-flow blower assembly comprises a motor 202 that is secured relative to a wall 204 using a four-legged motor mount 206. A backwards curved blade assembly 208 is attached to the motor 202 and is positioned generally between the motor 202 and a hole 210 in the wall 204. In operation, the motor 202 rotates the backwards curved blade assembly 208 about an axis of rotation 220 so that leading edges 212 lead each blade 214 in rotation about the axis of rotation 220 as compared to the trailing edges 216. In this embodiment, the blade assembly 208 is rotated about the axis of rotation 220 in the direction indicated by arrow 218.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An air handling unit, comprising: a cabinet forming a duct having a primary airflow direction that extends through the duct in a substantially straight line path from an inlet disposed in a lower wall of the cabinet to an outlet disposed in an opposing upper wall of the cabinet; a mixed-flow blower assembly configured to provide airflow through the duct, wherein an upstream end of a motor of the mixed-flow blower assembly is located downstream relative to a downstream end of a blade assembly of the mixed-flow blower assembly, and wherein an axis of rotation of the mixed-flow blower assembly is substantially parallel to the primary airflow direction; and a refrigeration coil assembly disposed within the cabinet and downstream of the mixed- flow blower assembly, wherein the refrigeration coil assembly is a V-coil, and wherein a vertex of the V-coil is located substantially upstream of other portions of the V-coil; wherein a downstream boundary of a blower pressure zone is at least partially defined by an upstream boundary of the refrigeration coil assembly; wherein the blower pressure zone is further defined by the lower wall comprising the inlet through which the mixed-flow blower assembly draws air into the blower pressure zone; wherein the mixed-flow blower assembly is carried by the lower wall; wherein the motor and a substantial portion of the mixed-flow blower assembly are located within the blower pressure zone; wherein the blower pressure zone is free of any blade shroud configured to obstruct expulsion of air from the mixed-flow blower assembly in a substantially radial direction relative to an axis of rotation of the mixed-flow blower assembly; and wherein the mixed-flow blower is configured to expel air only in directions that are not straight paths toward the refrigeration coil assembly.

2. The air handling unit of claim 1, wherein the refrigeration coil assembly comprises a plurality of fin slabs.

3. The air handling unit of claim 2, wherein the plurality of fin slabs are configured so that the refrigeration coil assembly is substantially V-shaped.

4. The air handling unit of claim 1, wherein the mixed-flow blower assembly comprises a direct drive motor.

5. The air handling unit of claim 1, wherein the mixed-flow blower assembly comprises at least one backwards curved blade.

6. The air handling unit of claim 1, wherein the pressure within the blower pressure zone is substantially homogeneous near the refrigeration coil assembly.

7. An air handling unit, comprising: a cabinet forming a duct having a blower pressure zone and a primary airflow direction that extends through the duct in a substantially straight line path from an aperture disposed in a first wall of the cabinet to an outlet disposed in an opposing second wall of the cabinet; a mixed-flow blower assembly configured to provide airflow through the duct, the blower assembly comprising an axis of rotation generally parallel to the primary airflow direction, wherein an upstream end of a motor of the mixed-flow blower assembly is located downstream relative to a downstream end of a blade assembly of the mixed-flow blower assembly; and a refrigeration coil assembly disposed within the duct and configured to generally bound a downstream boundary of the blower pressure zone so that airflow generally exits the blower pressure zone through the refrigeration coil, wherein the refrigeration coil assembly is a V-coil, and wherein a vertex of the V-coil is located substantially upstream of other portions of the V-coil; wherein the first wall is configured to obstruct entry of airflow into the blower pressure zone through portions of the first wall other than the aperture so that airflow generally enters the blower pressure zone through the aperture, wherein the mixed-flow blower assembly is carried by the first wall; wherein at least most of a blade assembly of the mixed-flow blower assembly is disposed within the blower pressure zone; wherein the motor of the mixed-flow blower assembly is disposed within the blower pressure zone; wherein the blower pressure zone is free of any blade shroud configured to obstruct expulsion of air from the blade assembly in a substantially radial direction relative to the axis of rotation; and wherein the mixed-flow blower is configured to expel air only in directions that are not straight paths toward the refrigeration coil assembly.

8. The air handling unit of claim 7, wherein the blower assembly comprises a backwards curved blade assembly.

* * * * *